United States Patent [19]

Parish

[11] 4,205,286

[45] May 27, 1980

[54] TEMPERATURE STABILIZED HELICAL RESONATOR

[75] Inventor: Edward C. Parish, Ft. Worth, Tex.

[73] Assignee: Motorola, Inc., Schaumburg, Ill.

[21] Appl. No.: 881,308

[22] Filed: Feb. 27, 1978

[51] Int. Cl.[2] ..... H01P 7/00

[52] U.S. Cl. ..... 333/226; 333/229; 333/234

[58] Field of Search ..... 333/82 R, 82 B, 82 BT, 333/83 T

[56] References Cited

U.S. PATENT DOCUMENTS 3,621,484 11/1971 Shult ..... 333/82 B

*Primary Examiner*—Alfred E. Smith

*Assistant Examiner*—Robert E. Wise

*Attorney, Agent, or Firm*—James W. Gillman; James A. Scheer

[57] ABSTRACT

The coil form for a helical resonator is comprised of two sections connected by a flexible joint. The coil form/winding assembly is positioned within a cavity such that the ends of the coil forms are affixed to the cavity walls. A tuning screw threads into the cavity wall in tuning relation to the coil.

The resulting resonator structure maintains a low frequency drift characteristic over a wide temperature range due to the fixed tuning screw to coil spacing. Strain to the structure due to thermal stress is relieved by the flexible joint.

16 Claims, 2 Drawing Figures

TEMPERATURE STABILIZED HELICAL RESONATOR

BACKGROUND OF THE INVENTION

The present invention pertains to the electrical tuning art and, more particularly, to an improved cavity resonator.

Cavity resonators are well known, especially in the radio communication art. There, cavity resonators are used to provide selectivity at very high frequencies. A type of cavity resonator, known as a helical resonator, is generally comprised of a helically wound coil positioned within a resonant cavity. By appropriate adjustment of a provided tuning screw, the effective capacitance between the coil and the cavity is adjusted such that a series resonant LC circuit is formed. Several resonators are commonly coupled to provide the overall selectivity requirements of, for example, a radio receiver.

A principle problem with prior art helical resonators is temperature stability. For applications wherein a wide ambient temperature range is experienced, such as in mobile communication equipment, substantial drifts in the center frequency of the helical resonators have been experienced. In the prior art, the temperature drift of cavity resonators has been compensated for in at least one of three ways. Firstly, precision components may be used which exhibit very tight temperature characteristics. This approach results in a resonator which is expensive to manufacture. A second approach has been to broad tune the resonators such that the substantial thermal drifts can be tolerated. This approach is undesirable in that it sacrifices selectivity. A third approach sacrifices the tuning sensitivity for enhanced temperature sensitivity.

SUMMARY OF THE INVENTION

It is an object of this invention, therefore, to provide an improved resonator which is simple and inexpensive to manufacture but which exhibits excellent thermal stability.

Briefly, according to the invention, a resonator assembly includes a conductive winding which is supported on a coil form with the resulting assembly being positioned in a cavity. A tuning element, such as a tuning screw, is located in circuit configuration with the winding. The improvement is comprised of the coil form having first and second sections, each section supporting a portion of the winding. The two coil sections are interconnected such that the axes of the coil portions supported thereon are substantially coincident. Further, the interconnection provides strain relief between the coil sections in the direction of the coincident axes. The axial end portions of the coil form are affixed, via suitable means, with respect to the resonant cavity and the tuning element.

By maintaining the spacing between the coil and the tuning element, the cavity exhibits excellent temperature stability. Stress, created by the differing temperature coefficients of expansion of the components of the resonator, is relieved by the strain relief provided by the interconnection.

DETAILED DESCRIPTION OF THE PREFERRED EMBODIMENTS OF THE INVENTION

Figure 2:
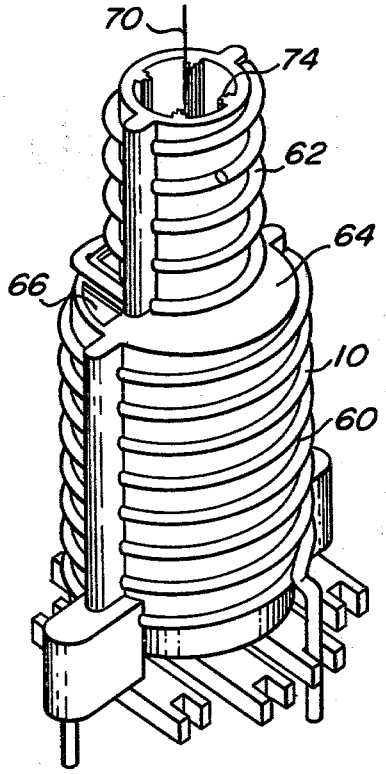
FIG. 2 is a perspective view of the coil form shown in FIG. 1.
Figure 1:
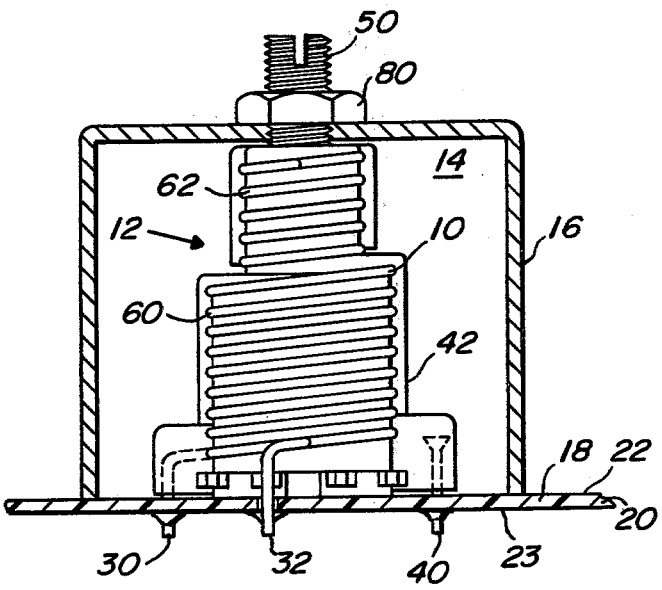
FIG. 1 is a cross-sectional view of the preferred embodiment of the cavity resonator according to the invention.

FIG. 1 is a cross-sectional view of the preferred embodiment of the helical cavity resonator. As with conventional helical cavity resonators, a helically wound conductive coil 10 is supported by a coil form, indicated generally at 12, and described more fully hereinbelow especially with respect to FIG. 2. The coil/coil form assembly is positioned within a cavity, indicated generally at 14 which is comprised of a metal cover 16 and a base portion 18. In the preferred embodiment of the invention, the cover 16 is formed of cast aluminum and the base portion 18 is comprised of a printed circuit board having a central dielectric portion sandwiched between upper and lower copper surfaces 22, 23, respectively. The metal cover 16 is electrically connected by screws to the copper surfaces 22, 23 thereby establishing a DC and RF ground.

In accord with conventional practice, the coil end lead 30 is electrically grounded via solder or other suitable means to the copper surfaces 22, 23. The signal input to the resonator is taken through a tap 32 which is a nickel alloy lead in wire spot welded at a predetermined location on the coil winding corresponding to a desired electrical impedance.

As is well known in the art, signals may be inserted or extracted from the resonator via either aperture, direct current tap, loop or probe type coupling.

The coil form 12 is also anchored to the printed circuit board 18 via an anchor pin 40 which is molded into the outer cover 42 of the coil form 12. Anchor pin 40 is soldered to the upper and lower copper surfaces 22, 23.

A tuning screw 50 is received in a tapped aperture in the top surface of the cover 16. The screw is made of metal and, thus, is at DC and RF ground through metallic cover 16 and copper surfaces 22, 23. By rotation of screw 50, the relative spacing between it and the coil 10 may be adjusted.

With proper selection of the cavity 14, coil 10 and the spacing between the screw 50 and coil 10 a series resonant circuit is established which may be used to provide tuning selectivity at very high frequencies. Adjustment of the screw 50 alters the value of the coupling, or resonating capacitance of the coil 10, thereby altering the center frequency to which the resonator is tuned.

In helical resonators according to the prior art, the screw 50 was not affixed to be in a permanent spatial relationship with respect to the coil 10. Thus, for changes in operating temperature, the coefficients of thermal expansion of the various resonator components would result in a change in the screw 50 to coil 10 spacing. This resulted in a substantial change in the center frequency to which the resonator was tuned. For example, in tests conducted on a prior art helical resonator operating at approximately 160 MHz and with similar tuning sensitivity, a frequency drift of greater than 1 MHz was measured over an operating temperature change of 75° C.

The instant invention provides enhanced temperature stability over the helical resonators known in the prior art as may be understood as follows. With reference to both FIGS. 1 and 2, the coil form 12 is comprised of first and second sections 60, 62, respectively. The two sections 60, 62 are each cylindrical in shape, with the diameter of the first section 60 being greater than that of the second section 62. The first section 60 supports eight turns of the winding 10 whereas the second section supports three turns.

The two sections 60, 62 are interconnected by a portion 64 such that the axes of the coil portions supported thereon are substantially coincident. Interconnecting portion 64 also provides strain relief between the first and second sections 60, 62, in addition to torsional stability. The strain relief is provided both by a cut-out aperture 66 and by selecting the interconnecting portion 64 of a suitably compliant material, formed in a suitable thickness such that each section 60, 62 may independently move in the direction of a common coincident axis 70. Thus, the interconnecting portion 64 acts as a hinge between the sections 60, 62.

The strain relief provided by the interconnecting portion 64 relieves stress created by thermal effects while causing a minimum change in tuning frequency of the cavity resonator. In addition, the relief afforded by the interconnecting portion 64 prevents undue stress on the printed circuit board 20 which might otherwise result in buckling or cracking of the board.

Preferably, the coil form 12 is one molded integral piece made from polypropylene.

Formed in the upper portion of second section 62 are a plurality of protrusions, one of which is shown at 74. These protrusions become tapped by the inserted screw 50, thereby mechanically affixing the screw 50 to the coil form 12. Once the spacing between the screw 50 and the winding 10 is established, a lock nut 80 is screwed over screw 50 and into frictional engagement with the cover 16. This permanently affixes adjusting screw 50 and the upper extent of coil form to the cavity 16 and it assures that the distance between the screw 50 and the coil 10 remains constant over varying temperatures. Thus, with the spacing constant, the capacitance remains constant and the resonator exhibits excellent thermal stability. In fact, a resonator according to the instant improvement having a tuned frequency of 160 MHz exhibited less than 100 KHz (typically less than 40 KHz) of drift in frequency over a 75° ambient temperature change. Thus, the temperature stability of the improvement according to the invention represents more than a magnitude improvement over the similar structure known to the prior art.

In summary, an inexpensive to manufacture yet highly temperature stabilized helical cavity resonator has been described.

While a preferred embodiment of the invention has been described in detail, it should be apparent that many modifications and variations thereto are possible, all of which fall within the true spirit and scope of the invention.

I claim:

1. In a resonator assembly wherein a conductive winding is supported on a coil form with the resulting assembly being positioned in a cavity and wherein a tuning element is located in circuit configuration with the winding, the improvement comprising:

said coil form having first and second sections, each section supporting a portion of the winding;

interconnecting means for mechanically interconnecting said first and second coil form sections such that the axes of the coil portions supported thereon are substantially coincident, said interconnecting means providing strain relief between the coil sections in the direction of said coincident axes; and means for affixing the axial end portions of said coil form with respect to said resonant cavity and said tuning element thereby maintaining a fixed spatial relationship between the resonant cavity and both ends of said coil form.

2. The improvement of claim 1 wherein said first coil section is comprised of a first cylinder having a predetermined diameter and axial length and wherein said second coil section is comprised of a second cylinder having a predetermined diameter and axial length, said second cylinder predetermined diameter being less than said first cylinder diameter and wherein said conductive winding is a helical coil wound about said first and second sections.

3. The improvement of claim 2 wherein said coil form is integrally formed.

4. The improvement of claim 3 wherein said interconnecting means is comprised of a predetermined material having a predetermined dimension to provide said strain relief.

5. The improvement of claim 4 wherein said interconnecting means is provided with aperture portions to further provide said strain relief.

6. The improvement of claim 4 wherein said tuning element is a screw which capacitively couples to said winding, said screw being threaded into said cavity and into one of said coil sections thereby forming a portion of said affixing means.

7. The improvement of claim 6 further comprising a lock nut for affixing said screw with respect to said cavity and said coil form.

8. The improvement of claim 2 wherein said tuning element is a screw which capacitively couples to said winding, said screw being threaded into said cavity and into one of said coil sections thereby forming a portion of said affixing means.

9. The improvement of claim 8 further comprising a lock nut for affixing said screw with respect to said cavity and said coil form.

10. The improvement of claim 1 wherein said coil form is integrally formed.

11. The improvement of claim 10 wherein said interconnecting means is comprised of a predetermined material having a predetermined dimension to provide said strain relief.

12. The improvement of claim 11 wherein said interconnecting means is provided with aperture portions to further provide said strain relief.

13. The improvement of claim 11 wherein said tuning element is a screw which capacitively couples to said winding, said screw being threaded into said cavity and into one of said coil sections thereby forming a portion of said affixing means.

14. The improvement of claim 13 further comprising a lock nut for affixing said screw with respect to said cavity and said coil form.

15. The improvement of claim 1 wherein said tuning element is a screw which capacitively couples to said winding, said screw being threaded into said cavity and into one of said coil sections thereby forming a portion of said affixing means.

16. The improvement of claim 15 further comprising a lock nut for affixing said screw with respect to said cavity and said coil form.

* * * * *